US006093115A

United States Patent [19]

Murtland et al.

[11] Patent Number: 6,093,115

[45] Date of Patent: Jul. 25, 2000

[54] GOLF CLUB HEAD WITH A BALL STRIKING FACE HAVING A DIRECTIONAL TENDENCY

[76] Inventors: Richard H. Murtland, 801 Legacy Dr., No. 1627, Plano, Tex. 75023; Byron H. Adams, 5909 Haraby Ct., Dallas, Tex. 75248; Robert Bush, 7238 Creathwood Cove, Germantown, Tenn. 75023; Michael Scott Burnett, 4937 Wagner Dr., The Colony, Tex. 75056

[21] Appl. No.: 09/203,563

[22] Filed: Dec. 2, 1998

[51] Int. Cl.[7] ..... A63B 53/04

[52] U.S. Cl. ..... 473/330

[58] Field of Search ..... 473/324, 330, 473/331

[56] References Cited

U.S. PATENT DOCUMENTS

| | | |
|---|---|---|
| 1,524,731 | 2/1925 | Davis . |
| 1,536,616 | 5/1925 | Manning . |
| 1,615,038 | 1/1927 | Reuter, Jr. . |
| 1,674,173 | 6/1928 | Haupt . |
| 2,023,885 | 12/1935 | Hinckley . |
| 2,395,837 | 3/1946 | Baymiller . |
| 4,367,878 | 1/1983 | Schmidt . |
| 4,413,825 | 11/1983 | Sasse . |
| 4,471,961 | 9/1984 | Masghati . |
| 4,521,022 | 6/1985 | Schmidt . |
| 5,098,103 | 3/1992 | Mackeil . |
| 5,141,231 | 8/1992 | Cox . |
| 5,310,185 | 5/1994 | Viollaz . |
| 5,333,873 | 8/1994 | Burke . |
| 5,415,405 | 5/1995 | Vincent . |
| 5,681,228 | 10/1997 | Mikame . |

FOREIGN PATENT DOCUMENTS

| | | |
|---|---|---|
| 5-177018 | 7/1993 | Japan . |

*Primary Examiner*—Sebastiano Passaniti
*Attorney, Agent, or Firm*—Aquilino, Welsh & Flaxman

[57] ABSTRACT

A golf club head for hitting a golf ball toward a target has a directional tendency to launch the golf ball in a selected direction. Basic embodiments include a club head having an asymmetric ball striking face such that one side of the face, as measured from the center of the face, has a first bulge radius and the other side of the face has a second bulge radius. The club head assumes a directional tendency in the direction toward the smaller bulge radius. Other embodiments of club heads with a directional tendency have a striking face with a bulge radius apex shifted either right or left of the center of the striking face such that a club face with the bulge radius apex to the left results in a right directional tendency and a club face with a bulge radius apex to the right results in a left directional tendency. Further embodiments of a club head may include a combination of a shifted bulge radius apex and a different radius on each side of the center of the striking face.

17 Claims, 5 Drawing Sheets

GOLF CLUB HEAD WITH A BALL STRIKING FACE HAVING A DIRECTIONAL TENDENCY

BACKGROUND AND SUMMARY OF THE INVENTION

The present invention relates to golf clubs and, in particular, to a wood type golf club head having an improved ball striking face configuration.

Traditionally wood type and metalwood type golf club heads have been provided with a bulge radius on the ball striking face used to offset the gear effect spin experienced when a ball is hit off of the center of percussion, that is toward the heel or toe. The bulge radius is the circular radius of the ball striking face in a horizontal plane with the club head positioned such as it would be positioned at address behind a golf ball prior to the execution of a golf stroke.

In a traditional golf club having a symmetrical club face configuration, the center of the radius of curvature of the bulge of the club face lies on a line perpendicular to the face angle of the club head and intersecting the geometrical center of the club face striking surface. The apex of the bulge radius is located at the point where this perpendicular line intersects the ball striking face. The face angle of the club face is defined by a horizontal line that forms a predetermined angle with a line extending from the geometric center of the club face to the target where the ball is intended to be hit. A square club face angle is perpendicular to the target line while a closed face angle is perpendicular to a line pointed left of target and an open face angle is perpendicular to a line pointed right of target.

The bulge radius controls the ball launch direction, but has no significant influence on the magnitude of the gear effect spin. Its purpose is to start a golf ball further to the right on toe shots and further to the left on heel shots, which creates a correction or compensation factor when the ball is struck off of the center of the club head, which, in turn, causes unwanted side spins resulting in hooking or slicing from the intended target.

When a golf ball is struck on a ball striking face, spin will be imparted if the golf ball is struck off center due to the well known gear effect phenomenon which is a function of the center of gravity location of the club head relative to where the golf ball is struck. For example, a golf ball struck toward the heel will have side spin that causes the ball to spin to the right of the intended target line. Similarly, a golf ball hit toward the toe has side spin which induces the ball to spin to the left of the target line.

The bulge radius of a golf club head does not effect the side spin imparted to a ball, however, it does effect the line of flight direction as the ball initially leaves the club face. For example, a ball hit toward the heel of the club head with too small a bulge radius will be launched too far left to the extent that the side spin is insufficient to enable a ball to recover its overall direction to the intended target line. Similarly, a ball hit on the toe will be launched too far right and the side spin will not be sufficient to bring the ball back to the target line.

Ideally, depending upon the gear effect spin a club produces as a function of the center of gravity location in the club head, the bulge radius may be adjusted to offset the ball flight curvature created by the spin to bring the ball back to the intended target line whether it is hit off center toward the heel or off center toward the toe.

Prior art golf clubs which are adjusted to provide a directional tendency either close or open the club face angle while leaving the club face configuration symmetrical. For example, a golf club with a left directional tendency would have a club face closed, for example, by two degrees, to overcome the right directional tendency of golfers who slice. Similarly, a golfer who draws a golf ball may use a club head with a one degree open face to hit straighter shots.

There have been some efforts made in the prior patented art to adjust the configuration of the ball striking face to affect the flight of the ball being struck by the club head. For example, U.S. Pat. No. 5,098,103 to MacKeil shows a golf club head having a fixed compensating loft where the face loft angle varies from the toe to the heel and is more lofted toward the heel than the toe. The purpose is to effect the ball trajectory when the ball is struck off of the center of gravity on the club face, thereby maintaining a more nearly constant loft angle.

U.S. Pat. No. 4,771,961 to Masghati et al. shows a golf club with a bulge radius where the weight is distributed on opposite sides of a non-vertical axis extending through the center of gravity such that wood type golf club heads have bulge and roll which curve about this axis and at an axis perpendicular thereto. Thus, the striking face has a convex curvature about a first axis which extends parallel to a second axis which extends through the center of gravity of the club head. These first and second axes lie in a plane which extends through the center of the striking face and which intersect the center line of the shaft above the club head.

U.S. Pat. No. 4,367,878 to Schmidt is directed to a golf club head having a bulge curvature defined by the intersection of generally horizontal planes normal to the ball striking face. These intersections defining curved lines which are generally parabolic when viewed from a position above the club head and spaced rearwardly of a line normal to the bottom surface such that the front face is tilted rearwardly.

The present invention relates to a golf club head with a directional tendency having an asymmetrical bulge or having a bulge radius apex displaced from the face center to control golf ball launch direction from the club face for golfers that tend to slice or hook a golf ball. The club head combines an asymmetrical or displaced bulge configuration with an appropriate gear effect to provide a launch direction minimizing hook and slicing spin. The structure of the club head will allow a large majority of golfers that tend to slice to hit straighter shots. Similarly, a golf club made in accordance with the present invention with an asymmetrical ball striking face can be used to minimize the misdirection of hooked golf shots.

Therefore, golf clubs made in accordance with the present invention will have a directional tendency so a golfer with a tendency to slice will be able to use a golf club with a left directional tendency and a golfer who tends to hook the ball will be able to use a golf club with a right directional tendency. For example, by increasing the bulge radius on the toe and decreasing the radius on the heel, a golf club is created with a left directional tendency. Similarly, a left directional tendency can be created by moving the apex of the bulge radius toward the toe. In like manner, providing a large radius on the heel and a smaller radius on the toe, creates a golf club having a right directional tendency. This also can be achieved by moving the apex toward the heel. The bulge configuration of the ball striking face of the golf club head is determined through test and analysis. The local face angle at the apex can be calculated for any given bulge configuration and apex location to guide the test and analysis.

An object of the present invention is the provision of a golf club head having an asymmetric shape for the purpose of changing the directional tendency of the club head.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The details of embodiments of the present invention are disclosed herein. It should be understood, however, that the disclosed embodiments are merely exemplary of the invention, which may b e embodied in various forms. Therefore, the details disclosed herein a re not to be interpreted as limited, but merely as the basis for the claims and as a basis for teaching one skilled in the art how to make and/or use the invention.

Figure 1:
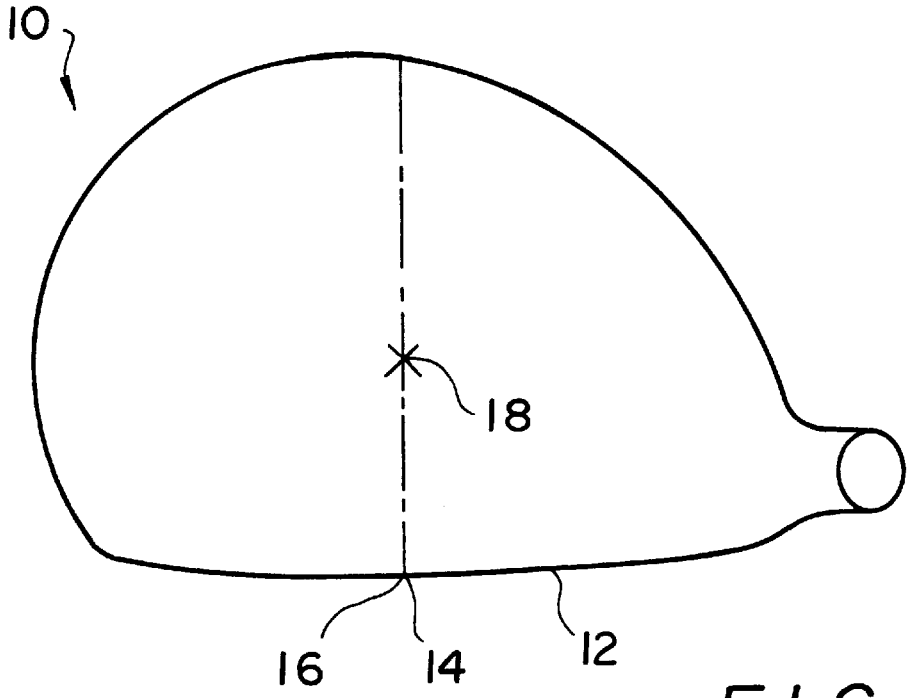
FIG. 1 PRIOR ART
FIG. 1 is a top plan view of a traditional prior art type golf club head.

FIG. 1 shows a traditional golf club head 10 having a symmetrically shaped ball striking face. As can be seen, the radius of the ball striking face 12 is a constant curvature with a curve apex at the face center 14, which ideally is coincident with the center of percussion 16 and is directly in line with the center of gravity 18 of the club head 10. Typically, the bulge radius of club heads vary between 10 and 16 inches with a 14 inch bulge radius being common. With the symmetrical bulge structure, the club head does not have directional tendencies and a ball struck, for example, on the heel will have a face launch angle to the left to compensate for the gear effect which will spin the ball to the right, and a ball struck on the toe will have a launch angle to the right to compensate for the gear effect which will tend to spin the ball to the left. Both of these shots should ideally land on the centerline to the intended target.

Figure 2:
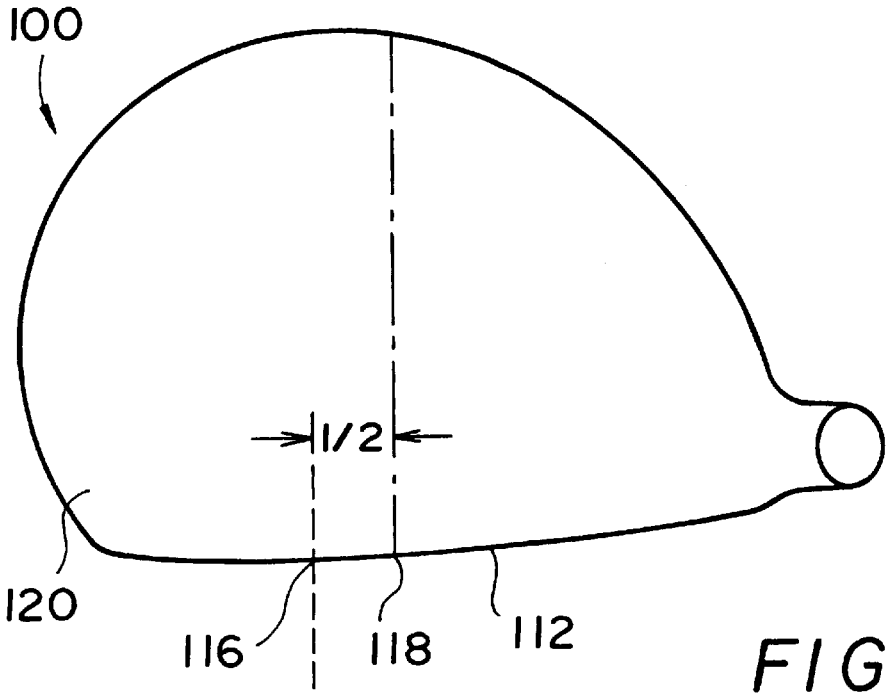
FIG. 2 is a top plan view of a first embodiment of a golf club head in accordance with the present invention with a bulge radius shift toward the toe.

FIG. 2 illustrates one embodiment of a golf club head 100 having a directional ball striking face 112 in accordance with the present invention. In this embodiment, the bulge radius is also 14 inches but has the apex 116 of the radius offset from the center 118 of the striking face 112 toward the toe 120 by an amount, for example, ½ inch. This will create approximately a 2 degree difference in the face angle at the apex and create a golf club having a left directional tendency.

Figure 3:
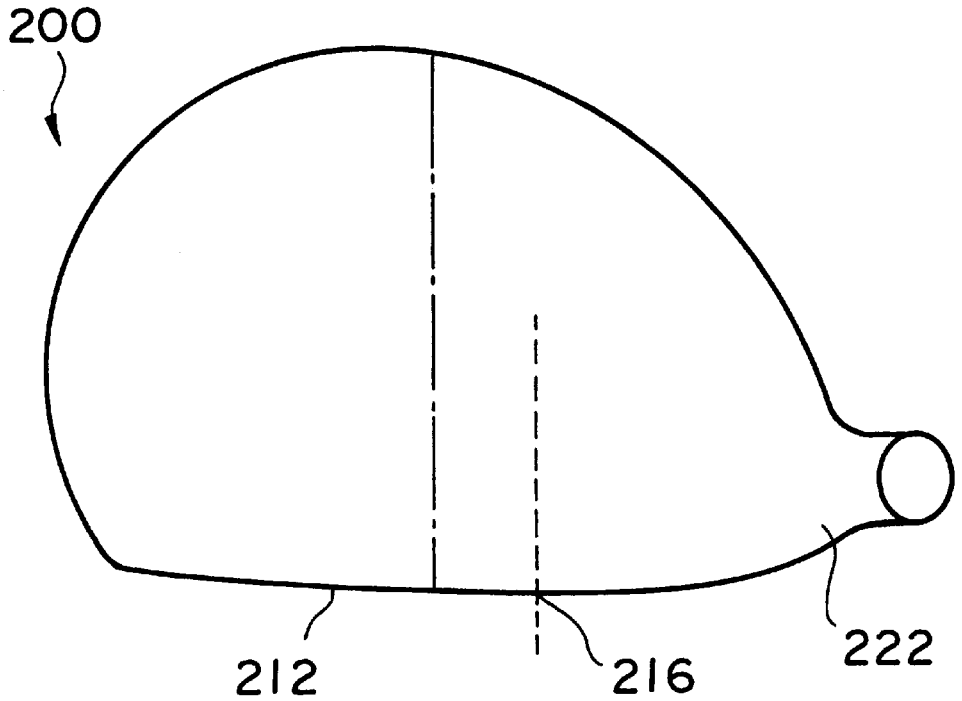
FIG. 3 is a top plan view of a second embodiment of a golf club head in accordance with the present invention with a bulge radius apex shift toward the heel.

FIG. 3 illustrates an embodiment of a golf club head 200 having a ball striking face 212 with a bulge radius of 14 inches where the apex 216 is offset from the center of the striking face 218 toward the heel 222 by ½ inch, thus creating a 2 degree difference in the face angle at the apex with a directional tendency to the right. Typically a 2 degree left or right directional tendency will create an initial ball flight direction that is of 10–20 yards left or right of target for a 250 yard shot, thereby offsetting the gear effect causing the ball to spin in the opposite direction.

Figure 4:
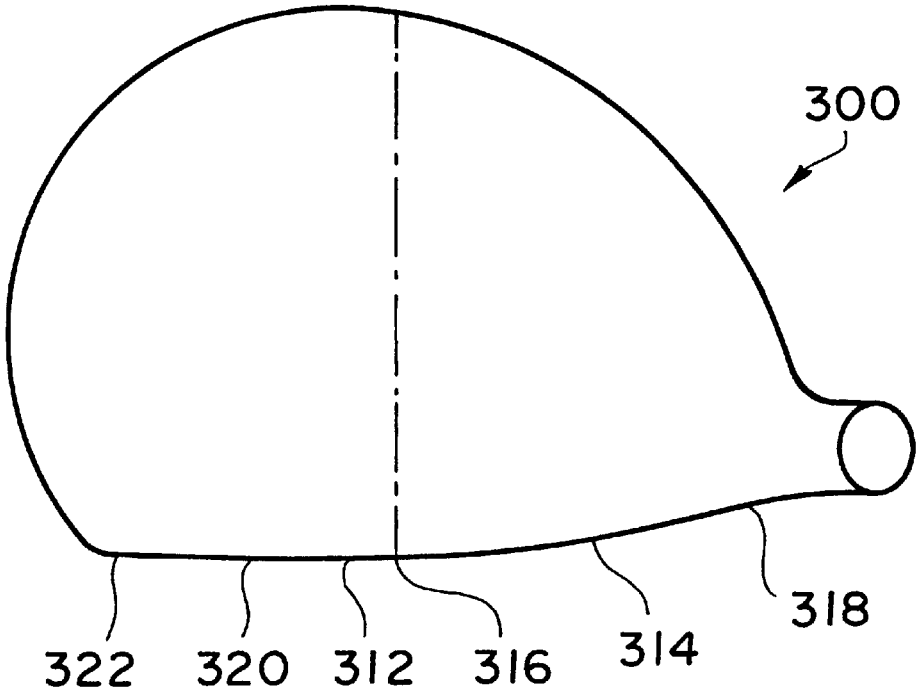
FIG. 4 is a top plan view of a third embodiment of a golf club head in accordance with the present invention having a dual bulge radius with a left directional tendency.

FIG. 4 illustrates a still further embodiment of a club head 300 in accordance with the present invention having a different bulge radii on the ball striking face 312. A heel portion 314 of the ball striking face 312 has an 8 inch bulge radius between the center 316 of the striking face 312 and the heel edge 318 of the striking face 312. A toe portion 320 of the ball striking face 312 has a bulge radius of three times that of the heel portion, namely a 24 inch bulge radius between the center 316 and the toe edge 322 of the striking face 312. Since there is a directional tendency toward the smaller bulge radius, this golf club head has a directional tendency to the left and would be used by golfers who tend to slice a golf ball.

Figure 5:
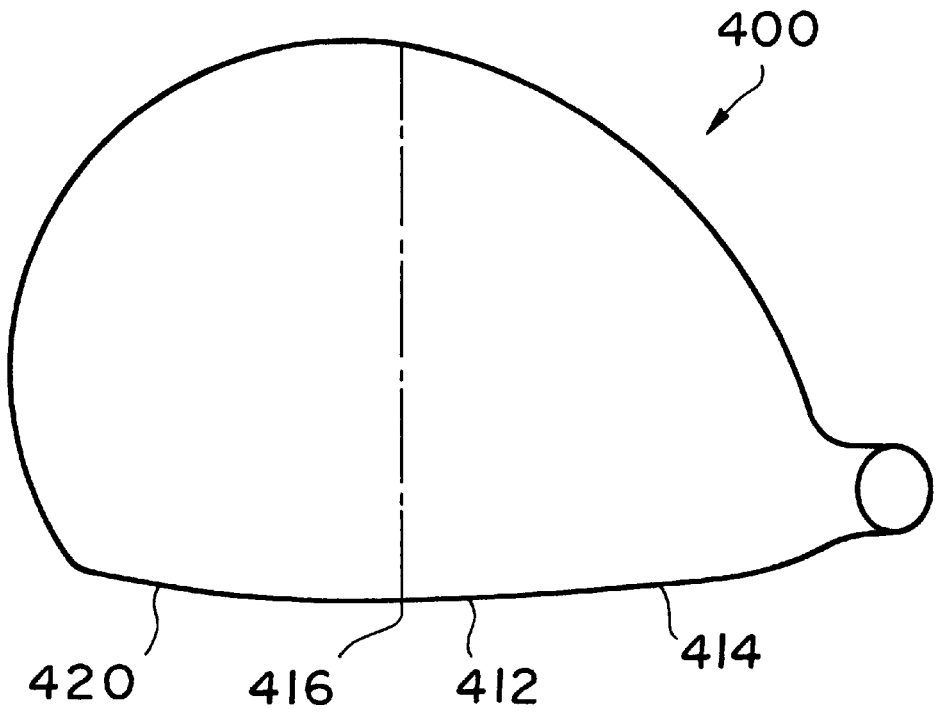
FIG. 5 is a top plan view of a forth embodiment of a golf club head in accordance with the present invention having a dual bulge radius with a right directional tendency.

FIG. 5 shows another embodiment of a club head 400 in accordance with the present invention having a different bulge radius on a heel portion 414 and a toe portion 420 of the ball striking face 412 with the bulge radius apex 416 at the center of the striking face 412 wherein the heel bulge radius is 24 inches and the toe bulge radius is 8 inches. This provides a club head with a right launch angle directional tendency and is appropriate for use by a golfer having a tendency to hook a golf ball.

Figure 6:
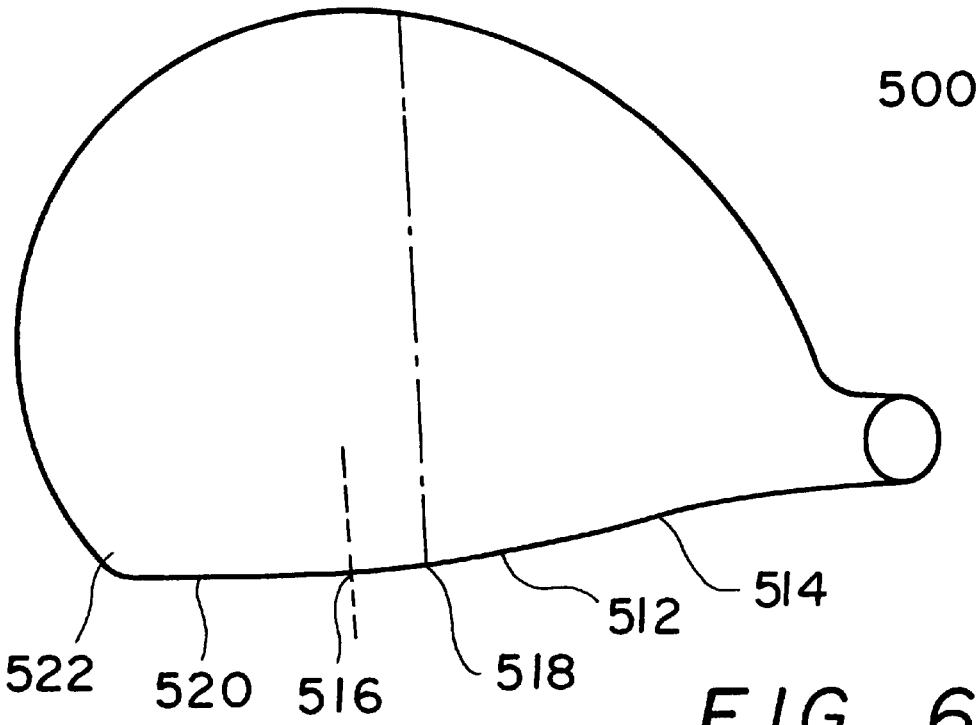
FIG. 6 is a top plan view of a fifth embodiment of a golf club head in accordance with the present invention showing a combination of a dual bulge radius and apex shift.

It will be appreciated that both a bulge radius apex shift as well as an asymmetrical bulge radius configuration may be combined to create a golf club head with a desired directional tendency. Referring to FIG. 6, a golf club head 500 has a ball striking face 512 with a heel portion 514 having a bulge radius of 8 inches and a toe portion 520 having a bulge radius of 24 inches. In addition, the juncture 516 between the two bulge radii portions 512 and 514 is displaced or shifted from the face center 518 toward the toe 522 approximately ½ inch. This creates a club head 500 having a left directional tendency and would be used by golfers tending to slice the ball.

Figure 7:
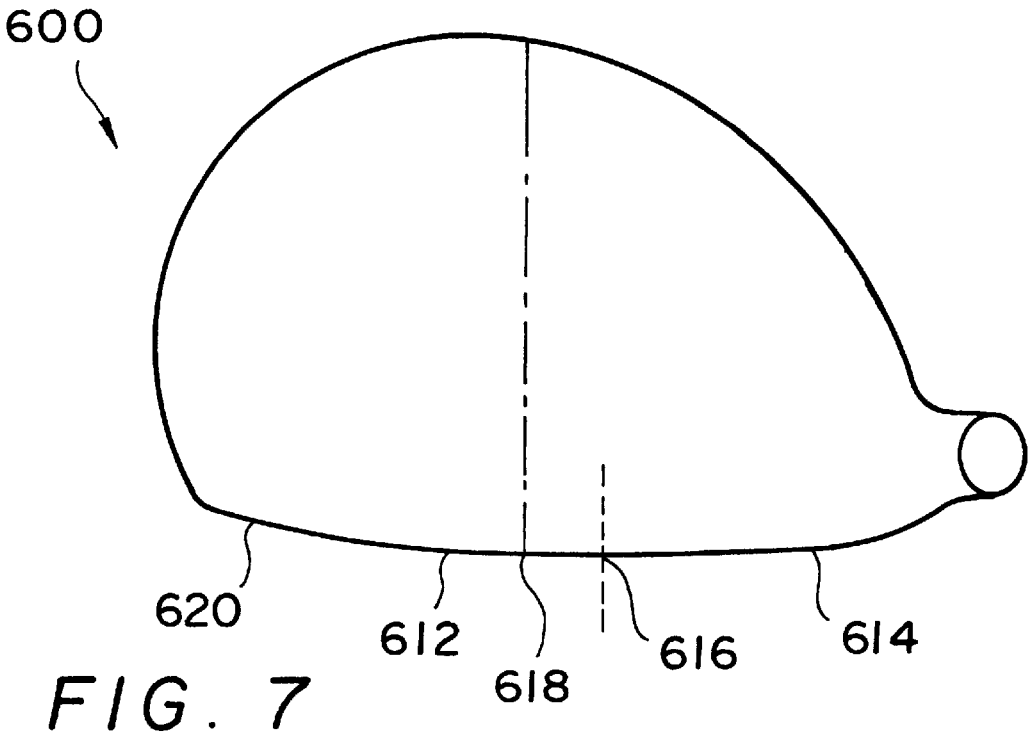
FIG. 7 is a top plan view of a sixth embodiment of a golf club head in accordance with the present invention showing a dual bulge radius and apex shift.

FIG. 7 shows a golf club head 600 having a ball striking face 612 with a different bulge radius on the heel portion 614 and on the toe portion 620. In this embodiment, the bulge radius at the heel 624 is 24 inches and the bulge radius at the toe 622 is 8 inches. In addition, the juncture 616 between the two bulge radii is shifted toward the heel 624 from the face center 618 approximately ½ inch. This creates a right directional tendency club head and would normally by used by golfers who tend to hook the ball.

Figure 8:
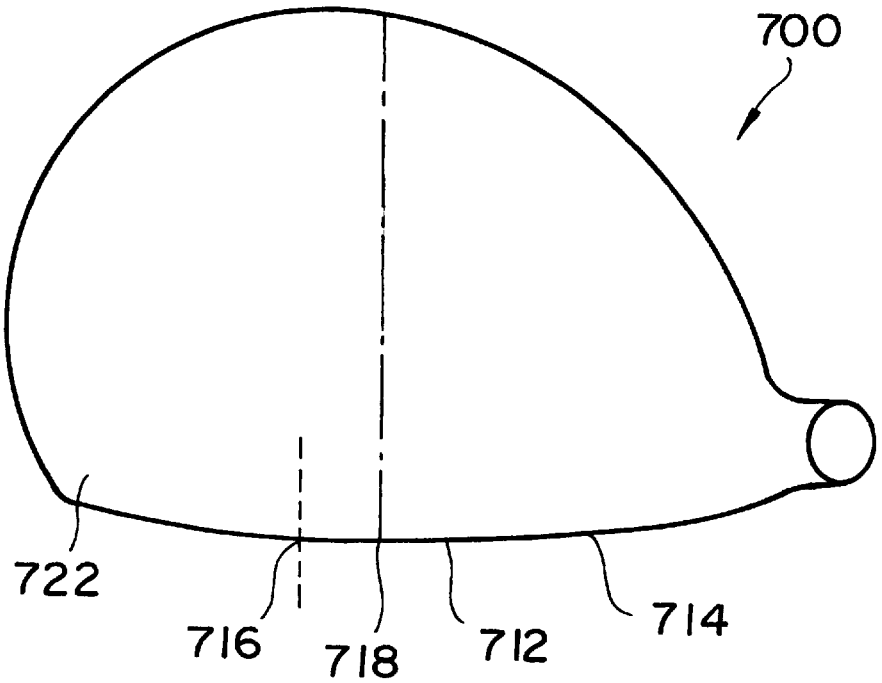
FIG. 8 is a top plan view of a seventh embodiment of a golf club head in accordance with the present invention showing a dual bulge radius and apex shift.

It will be appreciated that the club heads may also be made with a bulge radius configuration providing a left or right directional tendency along with a bulge radius apex shift providing a launch angle directional tendency in the opposite direction. This would be done to create a club head which appears more symmetrical to a golfer. For example, FIG. 8 illustrates a golf club head 700 having a ball striking face 712 wherein a heel portion 714 has a bulge radius of 24 inches and a toe portion 720 has a bulge radius of 8 inches. In this embodiment, the juncture 716 between the toe and heel portion is shifted from the center 718 toward the toe 722.

Figure 9:
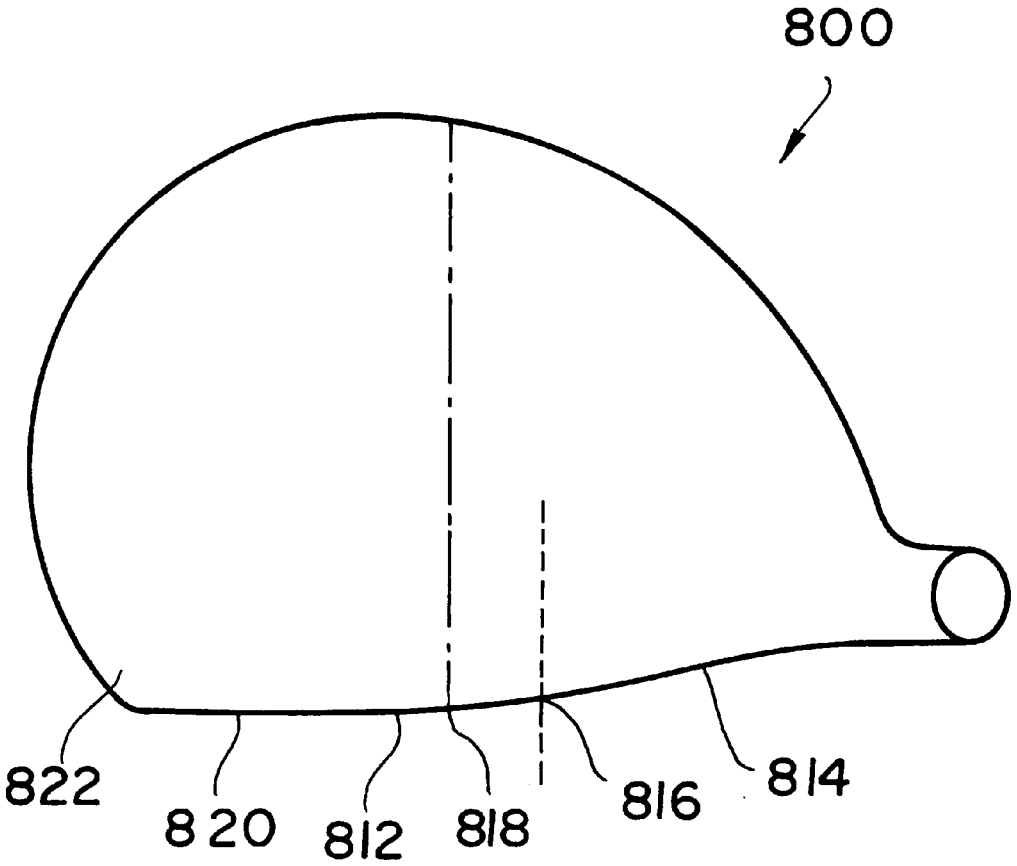
FIG. 9 is a top plan view of an eighth embodiment of a golf club head in accordance with the present invention showing a dual bulge radius and apex shift.

FIG. 9 illustrates a golf club head 800 having a ball striking face 812 with a heel portion 814 having a bulge radius of 8 inches and a toe portion 820 having a bulge radius of 24 inches. In this embodiment, the juncture 816 between the toe and heel portions is shifted from the center 818 toward the toe heel 814.

Typically, a design process for creating a custom golf club head with an asymmetrical ball striking face with a directional tendency has four steps. Step 1 is to determine the desired directional tendency of a golf club, for example, a 10 yard left directional tendency for a 250 yard drive. The second step is to design an asymmetrical bulge with a face angle at the apex to produce the desired directional tendency, for example, a 14 inch bulge radius with the apex ½ inch toward the toe, which results in a 2 degree left directional tendency. The third step is to machine test the club using a robot to obtain the actual directional tendency characteristics, and the fourth step is to adjust the asymmetrical bulge as required to meet the directional tendency goal whereby the directional tendency caused by the face angle at the apex compensates for the gear effect spin due to the offset between the actual location where the ball is struck and the center of percussion of the club head.

It will be appreciated that a wide variety of club head designs are possible in accordance with the present invention. By selectively varying the bulge radius across the ball striking face and/or the location of the apex of the bulge radius an infinite variety of launch angle directional tendencies may be achieved. Thus, better players with more constant swings and less tendency to hook or slice a ball may use a golf club with less directional tendency whereas less proficient players with greater hooking or slicing tendencies would use a club head designed with greater directional tendencies.

While various preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. A golf club head for hitting a golf ball toward a target, said club head including a club head body with a heel, toe, upper and lower surfaces, and a ball striking face on said club head body between said toe and said heel including a center located along said ball striking face; wherein the improvement comprises:

an asymmetrical bulge on said ball striking face having an apex offset from said center location on said ball striking face to provide a directional tendency for launching a golf ball in a specific direction offset from a line perpendicular to the target;

said asymmetrical bulge on said ball striking face being further defined by having a nonconstant radius of curvature including at least a first radius on one side of said apex and at least a second radius on an opposite side of said apex.

2. The golf club head of claim 1 wherein said apex is offset from said center of said ball striking face approximately ½ inch.

3. The golf club head of claim 1 wherein said club head has a left directional tendency; said apex being offset toward the toe of said club head from said center of said ball striking face.

4. The golf club head of claim 1 wherein said club head has a right directional tendency; said apex being offset toward the heel of said club head from said center of said ball striking face.

5. The golf club head of claim 1, wherein said ball striking face has a first radius of curvature located between said centered location and the toe of said club head identified as the toe portion of the ball striking face and a second smaller radius of curvature located on said ball striking face between said centered location and the heel of said club head identified as the heel portion of said ball striking face.

6. The golf club head of claim 1, wherein said ball striking face has a first radius of curvature adjacent said heel and a second smaller radius of curvature adjacent said toe.

7. The golf club head of claim 5 wherein said first radius of curvature is approximately three times larger than said second smaller radius of curvature.

8. The golf club head of claim 7, wherein said heel portion has a bulge radius of 8 inches and said toe portion has a bulge radius of 24 inches.

9. The golf club head of claim 6 wherein said first radius of curvature is approximately three times larger than said second smaller radius of curvature.

10. The golf club head of claim 9, wherein said first radius of curvature is 24 inches and said second smaller radius of curvature is 8 inches.

11. A golf club head for hitting a golf ball toward a target, said club head having a heel, toe, upper and lower surfaces and a ball striking face with a center location along said ball striking face between said toe and said heel; wherein the improvement comprises:

an asymmetrical bulge on said ball striking face defined by a non-constant radius of curvature including a first radius of curvature and second radius of curvature with an apex located between said first radius of curvature and second radius of curvature, said apex being offset from said center location along said ball striking face to provide a directional tendency for launching a golf ball in a specific direction.

12. The golf club head of claim 11, wherein said non-constant radius of curvature includes a large radius of curvature at a toe portion of said club head extending from said centered location to said toe and a smaller radius of curvature at a heel portion of said ball striking face extending from said centered location to said heel; and, an apex of said bulge located offset toward said toe or heel from said centered location.

13. The golf club head of claim 11, wherein said non-constant radius of curvature includes a large radius of curvature at a heel portion of said club head extending from said centered location to said heel and a smaller radius of curvature at a toe portion of said ball striking face extending from said centered location to said toe; and, an apex of said bulge located offset toward the toe or heel from said centered location.

14. The golf club head of claim 12 wherein said apex is offset toward said toe.

15. The golf club head of claim 12 wherein said apex is offset toward said heel.

16. The golf club head of claim 13 wherein said apex is offset toward said toe.

17. The golf club head of claim 13 wherein said apex is offset toward said heel.

* * * * *